United States Patent [19]

Benjamin et al.

[11] 4,226,034

[45] Oct. 7, 1980

[54] VACUUM SNOW REMOVER FOR REMOVING SNOW FROM ROADS AND OTHER SNOW COVERED SURFACES

[76] Inventors: Irving Benjamin; Diana M. Benjamin, both of 7539 E. Prairie Rd., Skokie, Ill. 60076

[21] Appl. No.: 957,734

[22] Filed: Nov. 6, 1978

[51] Int. Cl.[3] ..... E01H 5/10

[52] U.S. Cl. ..... 37/12; 126/271.2 C; 15/340

[58] Field of Search ..... 37/12; 126/343.5 R, 126/271.1, 271.2 R, 271.2 C; 15/314, 326, 340

[56] References Cited

U.S. PATENT DOCUMENTS

| | | | |
|---|---|---|---|
| 939,461 | 11/1909 | Willsie | 37/12 |
| 980,983 | 1/1911 | Meindl | 37/12 |
| 1,560,612 | 11/1925 | Sims | 37/12 |
| 3,052,908 | 9/1962 | Daneman | 15/340 |
| 3,189,021 | 6/1965 | Giguere | 37/12 X |
| 3,189,932 | 6/1965 | Daneman | 15/340 |
| 3,193,867 | 7/1965 | Daneman et al. | 15/314 |
| 3,333,354 | 8/1967 | Kirshenblat | 37/12 |
| 3,348,258 | 10/1967 | Daneman | 15/314 |
| 3,404,470 | 10/1968 | Raiti | 37/12 |
| 3,431,583 | 3/1969 | Daneman | 15/326 |
| 3,444,581 | 5/1969 | Daneman | 15/314 |
| 3,452,459 | 7/1969 | Campion | 37/12 |
| 3,474,484 | 10/1969 | Daneman | 15/314 |
| 3,619,918 | 11/1971 | Morin | 37/12 |
| 3,766,586 | 10/1973 | Krickovich | 37/12 |
| 4,071,966 | 2/1978 | Cohen | 37/12 |
| 4,164,820 | 8/1979 | Krickovich | 37/12 |

FOREIGN PATENT DOCUMENTS

| | | | |
|---|---|---|---|
| 615273 | 2/1961 | Canada | 37/12 |
| 486107 | 1/1976 | U.S.S.R. | 37/12 |

*Primary Examiner*—E. H. Eickholt

*Attorney, Agent, or Firm*—Dressler, Goldsmith, Shore, Sutker & Milnamow, Ltd.

[57] ABSTRACT

A vacuum snow remover and method for removing snow from roads and other snow covered surfaces is provided. The pneumatic snow remover assembly includes a fan for creating a suction pressure to draw snow up from the road into a collection tank via a main intake conduit. A melting chamber having heated tubes melts the snow in the collection tank. The melted snow collects in a basin below the melting chamber where it can be discharged into a sewer, open field or other area as desired via a discharge outlet. The vacuum snow remover also has an auxiliary inlet conduit which may be manually manipulated for pneumatically removing snow from curbs, sidewalks, and other places which cannot be easily reached by the main intake conduit. In the preferred embodiment, the vacuum snow remover also features at least one snow-melting conduit with an auxiliary heater that blows heated air on ice and hardened snow on and along the road to enhance snow removal.

13 Claims, 5 Drawing Figures

VACUUM SNOW REMOVER FOR REMOVING SNOW FROM ROADS AND OTHER SNOW COVERED SURFACES

BACKGROUND OF THE INVENTION

This invention relates to powered snow removing equipment, and more particularly, to a vacuum snow remover and a method of removing snow from roadways.

Over the years a variety of snow removing equipment has been developed for removing snow from roadways. Typifying such prior art snow removal equipment are those found in U.S. Pat. Nos. 1,642,895, 1,742,968, 3,464,128, 3,619,918 and 4,071,966. Such prior art snow removing equipment has met with varying degrees of success.

Conventional snow removing equipment typically utilize a burdensome scoop, mechanical shovel, plow, screw conveyor, auger, brush or the like to remove snow from the roadway as the vehicle is moving. The scoop, shovel, auger, etc. usually have sharp blades or scrapers which often create potholes and other permanent deformation and damage to the streets and curbs, which leads to costly road repairs. The snow is subsequently conveyed to the vehicle's tank via a chute by the momentum of the moving vehicle. Sometimes, the snow is conveyed through the combined action of the momentum of the vehicle and an auxiliary conveying source, such as a blower or fan. In conventional snow removing equipment which utilize a blower or fan, the blower or fan does not remove the snow itself from the roadway, but serves only to create a suction to transfer the snow after it has been removed by the scoop, mechanical shovel, plow, screw conveyor, auger, brush, etc.

Moreover, with some types of conventional snow removing equipment the snow is first plowed into piles taking up much needed parking space in outside parking lots and shopping centers. The piled snow is then loaded and lifted by the crew of a second truck into a dump truck (third truck) where the snow is hauled to and dumped in an open field. This procedure is inefficient and costly.

It is therefore desirable to develop an improved snow remover and method of removing snow from roadways.

SUMMARY OF THE INVENTION

An improved method of removing snow from snow covered roads, driveways or the like is provided which obviates the need for burdensome scoops, mechanical shovels, plows, power driven augers, screw conveyors, brushes and the like. The method can be employed by a single truck and obviates the need to plow snow into piles which would otherwise occupy valuable parking space in outside parking lots and shopping centers. The novel method includes pneumatically removing snow from a snow covered road by drawing the snow away from the road with a suction pressure (vacuum) less than atmospheric pressure and pneumatically conveying the removed snow to a collection tank, where it is melted and subsequently discharged into a sewer, open field or the like.

One preferred apparatus for carrying out the novel method of this invention is a wheeled motorized vehicle or truck having a cab at its front end and a snow-receiving collection tank at its rear end. The truck has a main intake snow-receiving conduit which extends below the snow-receiving collection tank to a position closely adjacent the snow covered road. Desirably, the intake conduit is located rearwardly of the cab.

In order to pneumatically remove the snow, a power driven fan is operatively associated with the snow-receiving collection tank. The fan creates a suction pressure or vacuum to effectively draw snow up from the snow covered road into a main intake conduit and subsequently to the collection tank. Advantageously, snow can be removed by this novel apparatus, either when the vehicle is stopped or when the vehicle is moving.

Structurally, the snow-receiving collection tank has a melting chamber with a melting assembly, such as one or more heated tubes, to melt the snow in the collection tank. In the preferred form, the heated tubes extend longitudinally and laterally across the collection tank so as to form a criss-cross like grid with snow-receiving passageways therebetween for passage of the melted snow into a basin below the melting chamber. The basin has a discharge outlet, to which a hose may be connected, to drain the melted snow into a sewer, open field, etc.

In the preferred form, the vacuum snow remover includes at least one portable auxiliary inlet conduit or hose that is operatively connected to the fan to pneumatically remove snow from sidewalks, curbs and other places in proximity to the roadway, which are typically inaccessible to the main intake conduit.

Desirably, the vacuum snow remover also includes at least one portable snow-melting conduit hose that is operatively connected to the exhaust end of the fan to direct the air being blown from the exhaust fan onto the ice and snow covering the road and adjacent curb and sidewalk. Preferably, the auxiliary snow-melting conduit is operatively connected to an auxiliary heater, such as an internal electrical heating coil adjacent the outlet end of the hose, to heat the air being blown out of the snow-melting conduit.

A more detailed explanation of the invention is provided in the following description and appended claims taken in conjunction with the accompanying drawings.

DETAILED DESCRIPTION OF THE ILLUSTRATIVE EMBODIMENT

Figure 1:
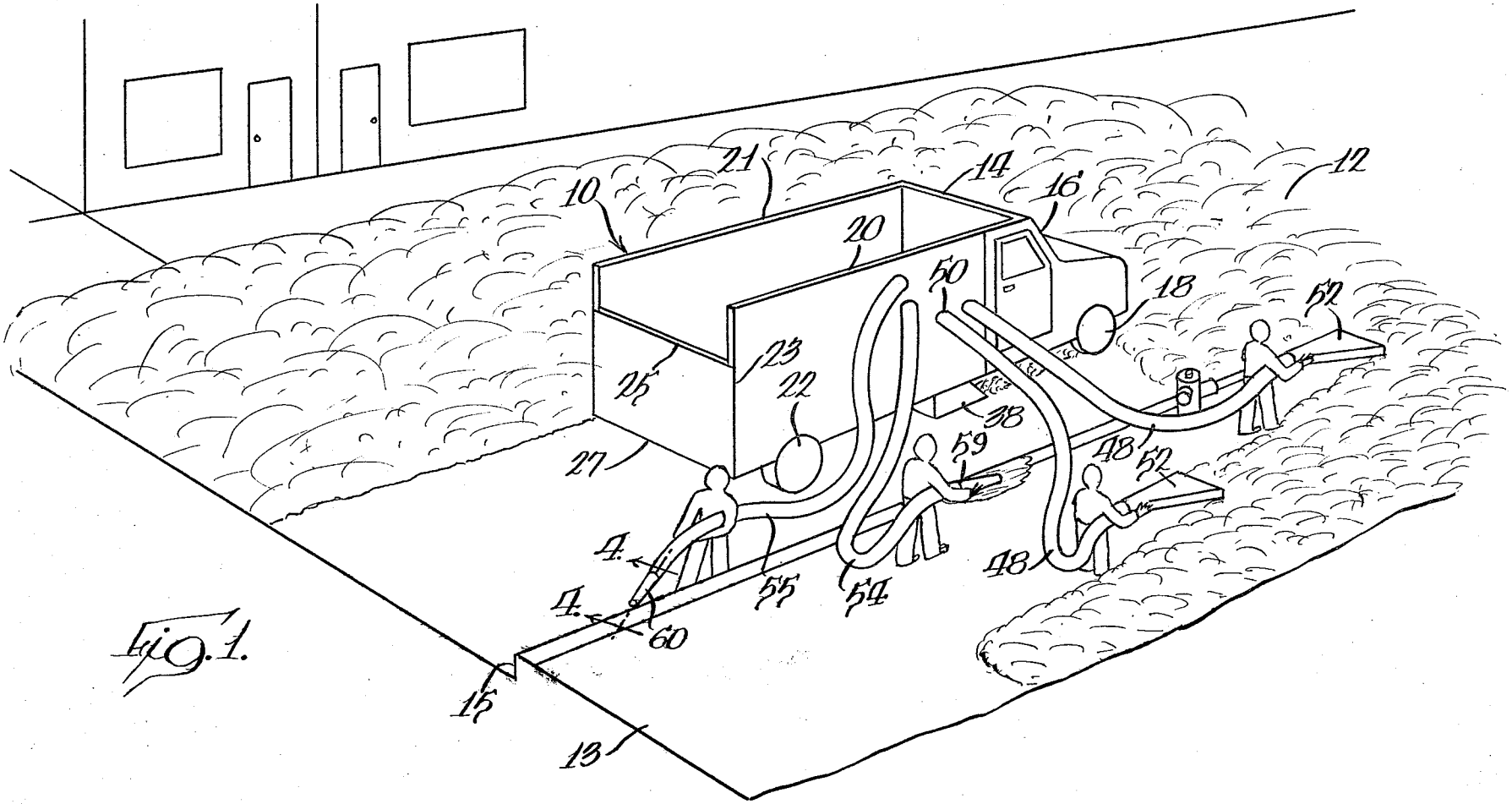
FIG. 1 is a perspective view of a vacuum snow remover in accordance with principles of the present invention.
Figure 2:
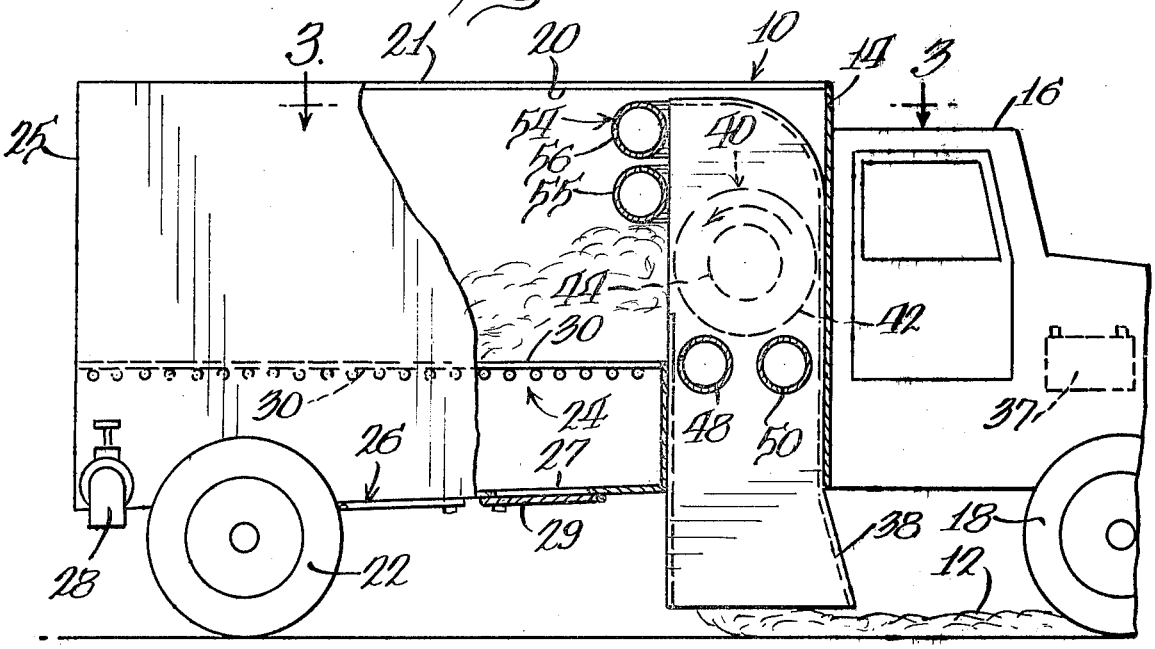
FIG. 2 is a longitudinal cross-sectional view of the vacuum snow remover.

The drawings illustrate a vacuum snow remover 10 which is particularly useful in pneumatically removing snow from snow covered roads 12, sidewalks 13, curbs 15, gutters, driveways, parking lots, shopping centers, etc. In the illustrative embodiment the vacuum snow remover is in the form of a motorized vehicle or truck 14 (FIGS. 1 and 2) with a cab 16 at its front end above the front wheels 18 and a snow-receiving collection tank or reservoir 20 at its rear end above the rear wheels 22. In the embodiment shown, the top 21 and upper end 25 of collection tank 20 are open to enable the crew of the truck 14 to manually shovel snow into the snow-receiving collection tank 20. In some circumstances, however, it may be desirable to have the top and end of the tank 20 covered, or have the sides 23 or other portions of the tank 20 equipped with access panels or doors.

The snow-receiving collection tank 20 is preferably rectangular in shape and has a melting chamber or area 24 (FIG. 2) which is located about one-third the height of the tank 20. While this shape and location is preferred, it may be desirable in some circumstances to use a cylindrical tank or a melting chamber that is positioned at a different location.

Figure 3:
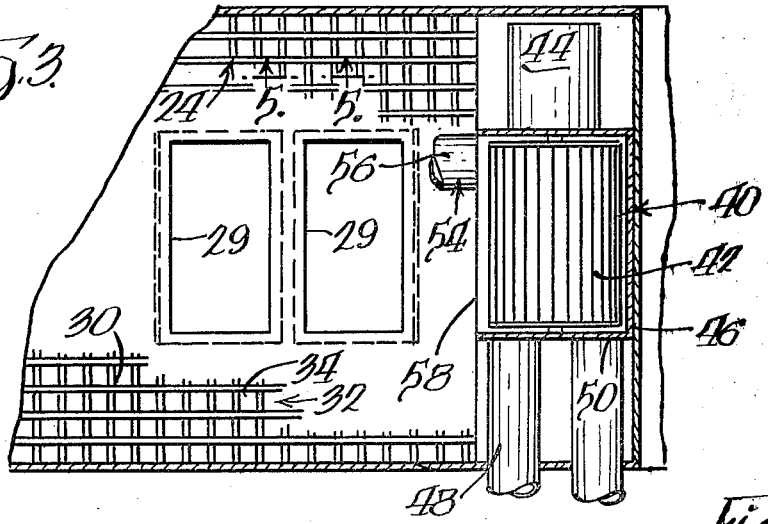
FIG. 3 is a top plan view of the vacuum snow remover taken substantially along line 3—3 of FIG. 2.

The bottom 27 of the tank 20 has a cradle-like configuration to provide a collection basin 26 below the melting chamber 24. The basin 26 receives the snow that has been melted by the melting chamber 24. The basin 26 slopes slightly downward toward the rear end of the tank 20 to define a discharge outlet or tap 28 for discharging the melted snow into a sewer, open field or the like with an extension hose (not shown). The bottom of the basin 26 has trap doors 29 (FIGS. 2 and 3) for discharging salt and other sediment that has collected in the bottom of the basin 26.

Figure 5:
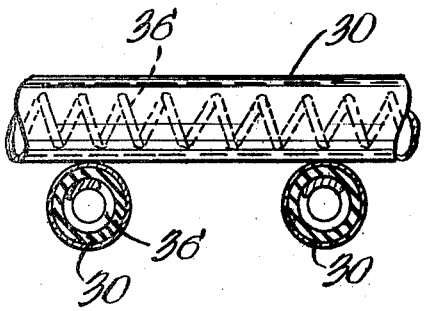
FIG. 5 is a longitudinal cross-sectional view of the heated tubes taken substantially along line 5—5 of FIG. 3.

The melting chamber 24 has and is defined by a plurality of heated tubes or pipes 30 (FIGS. 2 and 3) which extend generally longitudinally and laterally across the tank 20 to provide a criss-cross grid 32 for melting the snow. The grid 32 defines a plurality of melted snow-receiving passageways 34 between the heated tubes 30 for passage and drainage of the melted snow into the basin 26. In the embodiment shown, the tubes are internally heated by electrical heating wires or coils 36 (FIG. 5) which are connected to the generator or battery 37 of the truck 14. While the above type of melting chamber is preferred, it may be desirable in some circumstances to use other types of melting chambers such as pipes which are connected to the exhaust pipe (tail pipe) of the vehicle engine to receive the hot exhaust gases. In such cases adequate safety precautions should be taken to avoid asphyxiation and carbon monoxide poisoning.

Snow is received into the collection tank 20 via a main intake snow-receiving conduit or duct 38 (FIG. 2), which is generally stationary and rigid. The main intake conduit communicates with and extends below the tank 20 to a position immediately above and adjacent the snow covered road 12. The lower front portion of the main intake conduit 38 slopes downwardly and forwardly. Preferably, the main intake conduit 38 is located and spaced rearwardly of the cab 16 against the front end of the collection tank 20 within the tank 20. While this position is preferred, in some circumstances it may be desirable to mount the main intake conduit at a different location, either internally or externally of the tank 20.

In order to pneumatically remove the snow from the road 12 through the main intake conduit 38, a pneumatic snow remover assembly 40 with a power operated fan or blower 42 (FIG. 2) is mounted near the top 21 of the collection tank 20 to create a suction pressure or vacuum in the tank 20 less than the atmospheric pressure outside the tank 20. The pneumatic snow remover assembly 40 also includes an air filter 46. In the preferred embodiment fan 42 is a centrifugal type fan and is powered by an internal motor 44 housed within the pneumatic snow remover assembly 44. In some circumstances it may be desirable to use other types of fans or blowers or to have the fan directly powered by the engine of the vehicle 14 or located at a different position, such as externally of the tank 20.

In order to pneumatically remove snow from curbs 15, sidewalks 13, gutters and other places near the road 12 which are difficult to reach or are otherwise inaccessible to the main intake conduit 20, a pair of flexible auxiliary elongated inlet conduits or hoses 48 (FIG. 1) are provided. The outlet end 50 (FIGS. 2 and 3) of each flexible conduit 48 is operatively connected and pneumatically coupled to the fan 42 so as to communicate with the top portion of the collection tank 20. The inlet end 52 of each flexible conduit 48 is portable and provides manually graspable intake or suction portions 52 that can be grasped by the crew or personnel of the truck 14 to manipulate the inlet end 52 of each flexible hose 48 to the desired location. In the preferred embodiment, the inlet end 52 takes the form of a diverging triangular-shaped snow-receiving suction head with a generally planar top and bottom.

Auxiliary snow-melting conduit assemblies 54 (FIG. 1) are also provided for loosening and melting the surface ice, crust and hardened snow that has formed on top of and along the road 12, curb 15 and sidewalks 13, either prior to or in conjunction with removal of the snow by the main intake conduit 38 and the auxiliary inlet conduits 48. In the illustrative embodiment, the snow-melting conduit assemblies 54 has a pair of flexible snow-melting hoses 55 which are made of substantially fluid-impervious material. The inlet end 56 of each flexible snow-melting hose 55 is operatively connected and pneumatically coupled to the exhaust end 58 of the fan 42 to advantageously receive the air being blown from the fan 42. The outlet end 59 of each snow melting hose 55 has a converging portable nozzle 60 (FIG. 4) that can be manually grapsed by the crew of the truck 14 to manually direct the air being blown from the exhaust end 58 of the fan 42 onto the ice and snow covering the road 12, curbs 15, sidewalks 13, etc.

In the preferred embodiment, an auxiliary heater 62 (FIG. 4) in the form of an electrical heating wire or coil 66 that internally circumscribes the outlet end 59 of each snow melting hose 53 is connected to the generator or battery 37 of the engine of the truck 14 to heat the air being blown through the nozzle 60. While this arrangement is preferred, in some circumstances it may be preferred to use other types of auxiliary heaters either internally or externally or the snow melting hoses 55 to heat the air being blown through the hoses 55. If desired, the magnitude and propulsion of the air being blown through each hose 55 can be increased with a portable motorized fan (not shown) mounted adjacent the outlet end 59 of each hose 55.

Figure 4:
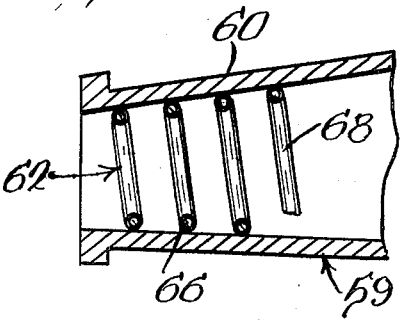
FIG. 4 is an enlarged cross-sectional view of the outlet end of a snow-melting conduit.

In order to prevent the snow being drawn into the inlet end 56 of each hose 55 from directly contacting the electrical heating wire or coil 66 and creating electrical shock and a potentially dangerous situation, the heating coils 66 are preferably coated with an electrical waterproof insulation 68 (FIG. 4).

In operation, the vacuum snow remover 10 pneumatically removes snow from the snow covered road 12 via the main intake conduit 38, and from the snow covered curbs 15 and sidewalks 13 via the flexible auxiliary intake conduits 48, by drawing the snow upwardly and away from the road 12, curbs 15 and sidewalks 13, with a suction pressure (vacuum) created by the fan 42. The removed snow is subsequently conveyed by the suction pressure through the main intake conduit 38 and auxiliary conduits 48 to the collection tank 20 where it is melted by the heated tubes 30 in the melting chamber 24. Ice and hardened snow can be melted and loosened by use of the heated air being blown through the snow melting hoses 55. After the snow in the collection tank 20 has been melted in the melting chamber 24, the melted snow will pass through the snow-receiving passageways 34 into the basin 26 under the influence of gravity. The melted snow in the basin 26 can be subsequently discharged through the discharge outlet 28 into a sewer, open field, etc., as previously discussed.

One of the many advantages of the present invention is that there is a substantially less likelihood of creating potholes and other permanent deformation and damage to the streets and curbs when the snow is removed by vacuum pressure by the subject vacuum snow remover than by conventional snow removing equipment which employs sharp blades and scrapers, thereby reducing the cost of road repairs. Furthermore, it is believed that the enormous expense of salting snow covered roads, as is presently done in many northern cities in the Midwestern part of the United States, can be substantially reduced with use of the present invention and that health hazards from accumulated snow that has been partially covered with dirt, soot and other debris can be minimized by the regular use of this invention.

While the vacuum snow remover of the present invention can effectively remove snow without the aid of a burdensome scoop, mechanical shovel, plow, auger, screw conveyor, etc., it may be desirable in some circumstances to use one or more of the foregoing mechanical snow removers with the present invention to assist in removing the snow or use an auxiliary lift mounted on the side of the truck to lift and dump some of the snow into the open tank.

The above detailed description has been given for ease of understanding only. No unnecessary limitations are to be understood therefrom, as modifications will be obvious to those skilled in the art.

What is claimed is:

1. A vacuum snow remover for removing snow from a snow covered road and the like, comprising:

a wheeled motorized vehicle for driving upon a snow covered road having a cab at its front end and a snow-receiving collection tank at its rear end;

a main intake conduit communicating with said snow-receiving collection tank and extending to a position adjacent said snow covered road, said intake conduit being located and spaced rearwardly of said cab;

pneumatic snow removing means including fan means operatively associated with said snow-receiving collection tank for creating a suction less than atmospheric pressure to effectively draw snow upwardly from said snow covered road through said main intake conduit and into said snow-receiving collection tank as said vehicle is stopped and while said vehicle is moving;

said snow-receiving collection tank having a melting chamber with melting means for melting said snow and defining a basin below said melting chamber for receiving said melted snow;

discharge means communicating with said basin for discharging said melted snow from said collection tank; and at least one auxiliary inlet conduit for drawing in snow from locations adjacent said road, said auxiliary inlet conduit having one end operatively connected to said fan means and communicating with said snow-receiving collection tank and another end defining a manually graspable intake portion adapted to be manually moved to said locations adjacent said road.

2. A snow remover in accordance with claim 1 wherein:

said main intake conduit is generally rigid and stationary, and said auxiliary inlet conduit is generally portable and flexible.

3. A snow remover in accordance with claim 1 wherein:

said fan means includes exhaust means for blowing air away from said fan means; and said vacuum snow remover further includes snow-melting conduit means having one end operatively connected to said exhaust means and another end defining a manually graspable outlet portion for manually directing said air being blown from the exhaust means of said fan means onto ice and snow covering and lying adjacent said road; and electrical heating wire means located adjacent said manually graspable outlet portion for heating the air being blown through said outlet portion of said snow-melting conduit means.

4. A snow remover in accordance with claim 3 wherein said electrical heating wire means includes a coil circumscribing said manually graspable outlet portion of said snow-melting conduit means.

5. A snow remover in accordance with claim 1 wherein said manually graspable intake portion of said auxiliary inlet conduit includes a nozzle having a diverging generally triangular shaped snow-receiving suction head with a generally planar top and bottom.

6. A snow remover in accordance with claim 1 wherein said melting chamber includes a criss-cross grid of electrically heated tubes electrically connected and energized by a battery in said wheeled motorized vehicle, said electrically heated tubes extending generally longitudinally and laterally across said collection tank to define a plurality of melted snow-receiving passageways for passage of melted snow into said basin.

7. A vacuum snow remover for removing snow from a snow covered road and the like without the aid of a brush, screw conveyor, plow or scoop, comprising:

a snow-receiving collection tank;

a main intake conduit having a lower front portion positioned away from any brush, screw conveyor, plow or scoop, said main intake conduit communicating with said snow-receiving collection tank and extending to a position adjacent said snow covered road;

pneumatic snow removing means positioned away from and operable wholly without said brush, screw conveyor, plow or scoop for removing snow from said snow covered road without the aid of said brush, screw conveyor, plow and scoop, said pneumatic snow means providing the primary source of removing snow from said snow covered road, said pneumatic snow removing means including fan means operatively associated with said snow-receiving collection tank for creating a suction to draw snow from said snow covered road through said main intake conduit and into said snow-receiving collection tank;

said snow-receiving collection tank having a melting chamber with melting means for melting said snow and defining a basin below said melting chamber for receiving said melted snow; and discharge means communicating with said basin for discharging said melted snow from said collection tank.

8. A vacuum snow remover for removing snow from a snow covered road and the like, comprising:

a wheeled motorized vehicle for driving upon a snow covered road having a cab at its front end and a snow-receiving collection tank at its rear end;

a generally stationary and rigid main intake conduit having a lower front portion defining an inlet, said main intake conduit communicating with said snow-receiving collection tank and extending to a position adjacent said snow covered road, said intake conduit being located and spaced rearwardly of said cab;

pneumatic snow-removing means providing the primary source of removing snow from said snow-covered road, said pneumatic snow removing means including fan means operatively associated with said snow-receiving collection tank for creating a suction less than atmospheric pressure to effectively draw snow upwardly from said snow covered road through said intake conduit and into said snow-receiving collection tank as said vehicle is stopped and while said vehicle is moving, said fan means including exhaust means for blowing air away from said fan means;

said snow-receiving collection tank having a melting chamber for melting said snow including a plurality of heated tubes extending longitudinally and laterally across said snow-receiving collection tank to define a criss-cross grid with a plurality of melted snow-receiving passageways, said snow-receiving collection tank defining a basin below said melting chamber for receiving said melted snow;

discharge means communicating with said basin for discharging said melted snow from said collection tanks;

at least one flexible auxiliary inlet conduit for drawing in snow from locations adjacent said road, said flexible auxiliary inlet conduit having one end operatively connected to said fan means and communicating with said snow-receiving collection tank and another end defining a portable manually graspable intake portion adapted to be manually moved to said locations adjacent said road;

snow-melting conduit means including at least one elongated flexible hose of substantially fluid-impervious material having one end operatively connected to said exhaust means of said fan means and another end of said hose including a nozzle defining a manually graspable outlet portion for manually directing said air being blown from said exhaust means of said fan means onto ice and snow covering and lying adjacent said road; and heating means including an electrical coil internally circumscribing said outlet portion of said snow-melting conduit means for heating said air being blown through said snow-melting conduit means.

9. A vacuum snow remover for removing snow from a snow covered road and the like, comprising:

a snow-receiving collection tank;

a main intake conduit communicating with said snow-receiving collection tank and extending to a position adjacent said snow covered road;

pneumatic snow removing means including fan means operatively associated with said snow-receiving collection tank for creating a suction to draw snow from said snow covered road through said main intake conduit and into said snow-receiving collection tank as said vehicle is stopped and while said vehicle is moving;

said snow-receiving collection tank having a melting chamber with melting means for melting said snow and defining a basin below said melting chamber for receiving said melted snow;

discharge means communicating with said basin for discharging said melted snow from said collection tank; and at least one auxiliary inlet conduit for drawing in snow from locations adjacent said road, said auxiliary inlet conduit having one end operatively connected to said fan means and communicating with said snow-receiving collection tank and another end defining a manually graspable intake portion adapted to be manually moved to said locations adjacent said road.

10. A snow remover in accordance with claim 9 wherein:

said fan means includes exhaust means for blowing air away from said fan means; and said vacuum snow remover further includes snow-melting conduit means having one end defining a manually graspable outlet portion for manually directing said air being blown from the exhaust means of said fan means onto ice and snow covering and lying adjacent said road.

11. A snow remover in accordance with claim 10 wherein said auxiliary snow-melting conduit means includes auxiliary heating means for heating said air being blown through said snow-melting conduit means onto said ice and snow.

12. A snow remover in accordance with claim 9 wherein said melting chamber includes a plurality of heated tubes defining a criss-cross grid with a plurality of melted snow-receiving passageways for passage of melted snow into said basin.

13. A vacuum snow remover for removing snow from a snow covered road and the like, comprising:

a wheeled motorized vehicle for driving upon a snow covered road having a cab at its front end and a snow-receiving collection tank at its rear end;

a main intake conduit having a lower front portion sloping downwardly and forwardly in a direction generally towards said cab, said lower front portion defining an inlet, said main intake conduit communicating with said snow-receiving collection tank and extending to a position adjacent said snow covered road, said intake conduit being located generally adjacent and spaced rearwardly of said cab;

pneumatic snow removing means providing the primary source of removing snow from said snow covered road, said pneumatic snow removing means including fan means operatively associated with said snow-receiving collection tank for creating a suction less than atmospheric pressure to effectively draw snow upwardly from said snow covered road through said main intake conduit and into said snow-receiving collection tank as said vehicle is stopped and while said vehicle is moving;

said snow-receiving collection tank having a melting chamber with melting means for melting said snow and defining a basin below said melting chamber for receiving said melted snow;

discharge means communicating with said basin for discharging said melted snow from said collection tank;

said fan means including exhaust means for blowing air away from said fan means;

said vacuum snow remover further including snow-melting conduit means having one end operatively connected to said exhaust means and another end defining a manually graspable outlet portion for manually directing said air being blown from the exhaust means of said fan means onto ice and snow covering and lying adjacent said road;

electrical heating wire means located adjacent said manually graspable outlet portion for heating the air being blown through said outlet portion of said snow-melting conduit means, said electrical heating wire means including a coil circumscribing said manually graspable outlet portion of said snow-melting conduit means; and electrical generally water-impervious insulating means covering at least a portion of said electrical heating wire means about said manually graspable outlet portion of said snow-melting conduit means for electrically insulating and waterproofing said electrical heating wire means at said manually graspable outlet portion from said ice and snow.

* * * * *